US005549801A

United States Patent [19]

Perlich et al.

[11] Patent Number: 5,549,801

[45] Date of Patent: Aug. 27, 1996

[54] EDGE STRIP FOR ELECTROLYTIC-CELL ELECTRODE

[75] Inventors: Frank J. Perlich, Tucson, Ariz.; Ron Tix, Hastings, Minn.; Graeme Alexander, Tucson, Ariz.

[73] Assignee: Quadna, Inc., Tucson, Ariz.

[21] Appl. No.: 533,464

[22] Filed: Sep. 25, 1995

[51] Int. Cl.[6] ..... C25D 17/00

[52] U.S. Cl. ..... 204/279; 204/281

[58] Field of Search ..... 204/279, 281

[56] References Cited

U.S. PATENT DOCUMENTS

| | | | |
|---|---|---|---|
| 3,798,151 | 3/1974 | Takamura et al. | 204/281 |
| 3,804,724 | 4/1974 | Bolger et al. | 204/281 X |
| 4,406,769 | 9/1983 | Berger | 204/281 |
| 4,776,928 | 10/1988 | Perlich | 204/281 X |
| 5,314,600 | 5/1994 | Webb et al. | 204/279 |
| 5,368,714 | 11/1994 | Tanaka et al. | 204/279 X |
| 5,470,450 | 11/1995 | Tanaka et al. | 204/279 |

*Primary Examiner*—Donald R. Valentine
*Attorney, Agent, or Firm*—Antonio R. Durando

[57] ABSTRACT

An electrode edge protector that includes an elongate strip having a substantially H-shaped cross-section in combination with an expansion member. The elongate strip comprises two lever-arm portions made of rigid material that define a longitudinal edge slot for receiving and wrapping around the edge of an electrode and an opposing expansion slot for receiving the expansion member. The rigid lever-arm portions are interconnected between the slots by a coextruded hinge member, made of resilient material which enhances the ability of the edge strip to adhere to the electrode in the edge slot as a result of the force exerted by the expansion member in the expansion slot.

20 Claims, 4 Drawing Sheets

EDGE STRIP FOR ELECTROLYTIC-CELL ELECTRODE

BACKGROUND OF THE INVENTION

1. Field of the Invention

This invention is related in general to electrolytic processes and equipment for electroforming, electrolytic extraction and refining of metals. In particular, it describes an improved edge strip used to prevent deposition of material on edges of electrode plates during electrolytic processes.

2. Description of the Related Art

The principle of electrolysis has been utilized for decades to extract metals and other cations from electrolytic solutions. The extraction process is carried out by passing an electric current through an electrolyte solution of the metal of interest, such as copper, zinc, gold, silver, or lead. The metal is extracted by electrical deposition as a result of current flow between a large number of anode and cathode plates immersed in cells of a dedicated extraction tank house. In electro-refining, the anode is made of a material that is dissolved and therefore is lost during the process; in electrowinning, the electrode is more permanent. In both processes, the cathode is generally constructed of a metal alloy, such as titanium or copper alloys and various grades of stainless steel resistant to corrosive acid solutions. In the most efficient processes, each cathode consists of a thin sheet of metal of uniform thickness (2–4 mm) disposed vertically between parallel sheets of anodic material, so that an even current density is present throughout the surface of the cathode. A solution of metal-rich electrolyte and various other chemicals, as required to maintain an optimal rate of deposition, is circulated through the extraction cells; thus, as an electrical current is passed through the anodes, electrolyte and cathodes, a pure layer of electrolyte metal is electro-deposited on the cathode surface, which becomes plated by the process.

Similarly, to purify a metal in a refinery process using electro-deposition, an anode of impure metal is placed in an electrolytic solution of the same metal and subjected to an electric current passing through the anode, electrolyte and cathode of each cell. The anode goes into solution and the impurities drop to the bottom of the tank. The dissolved metal then follows the current flow and is deposited in pure form on the cathode, which typically consists of a starter sheet of stainless steel. When a certain amount of pure metal has been plated onto the starter sheet, the cathode is pulled out of the tank and stripped of the pure metal.

In both processes the pure metal deposit is grown to a specific thickness on the cathode during a predetermined length of time and then the cathode is removed from the cell. It is important that the layer of metal deposited be recovered in uniform shapes and thicknesses and that its grade be of the highest quality, so that it will adhere to the cathode blank during deposition and be easily removed by automated stripping equipment afterwards. The overall economy of the production process depends in part on the ability to mechanically strip the cathodes of the metal deposits at high throughputs and speeds without utilizing manual or physical intervention. To that end, the cathode blanks must have a surface finish that is resistant to the corrosive solution of the tank house and must be strong enough to withstand their continuous handling by automated machines without pitting or marking. Any degradation of the blank's finish causes the electro-deposited metal to bond with the cathode resulting in difficulty of removal and/or contamination of the deposited metal.

It is also very important that metal deposition be avoided along the edges of the electrodes to prevent the formation of a continuous layer of deposit between opposite sides of the plate which would complicate and delay the stripping process. Thus, in order to prevent electrolyte build-up along the double-sided edges of the starter sheet that would impede the automated separation of the product at the end of each cycle, these edges are masked with an insulating strip fastened to the electrode. Such edge strips are designed to tightly wrap around the edges of the starter sheet and prevent deposition of material past the line of contact between the strip and the starter sheet. In order to improve contact between them, several kinds of edge strips have been developed with different advantages best suited to specific applications.

For example, U.S. Pat. No. 4,406,769 to Berger (1983) discloses an edge protector consisting of a strip having an H-shaped cross-section so as to provide open slots on opposite sides. One slot is defined between a pair of parallel jaws and is adapted for receiving the edge of an electrode; the other slot is substantially semicircular and is adapted to receive a tubular member in compression, so that its insertion results in a leveraged narrowing of the first slot and a corresponding tight frictional connection between the edge strip and the cathode.

In U.S. Pat. No. 4,776,928 (1988), Perlich describes a coextruded structure for an edge protector consisting of a rigid U-shaped member having parallel jaws that define a slot for receiving the edge of an electrode and a pair of resilient lips attached to the ends of the jaws to press tightly against the electrode edge, thereby impeding penetration of electrolyte. This patent first disclosed the concept of using dual-durometer coextruded members to improve gripping of the edge strip to the electrode surface.

In U.S. Pat. No. 5,314,600 (1994), Webb et al. introduced the concept of including a longitudinal groove within the edge slot for accommodating and engage transverse pins protruding from the electrode. This edge protector also includes expansion channels to facilitate the insertion of the electrode's edge into the protector's slot.

While amounting to substantial improvements over the prior art, these edge protectors retain some features that from time to time may still cause problems. Edge strips need to be sufficiently rigid to retain their shape over severe temperature cycles and maintain continuity of contact with opposite surfaces of the starter sheet's double-sided edges. At the same time, the compressive force exerted by the strip on the edge depends on the resilience of the strip's material, which is critical to ensure a sufficient degree of compression on the edge and prevent penetration of electrolyte solution during the deposition process. If the material is too rigid, the edge strip's performance becomes very dependent on a perfect fit of the starter sheet within the strip's edge slot; if too resilient, the strip may more easily conform to variations in smoothness and thickness in the starter sheet but it may also be easily deformed by shocks and buckling forces that result in electrolyte solution penetration and material deposition within the strips boundary.

Berger improved the clamping ability of edge strips by providing two opposing slots along the length of the strip: an edge slot for receiving the starter sheet edge and a lever slot for receiving an elongate expansion member. This leveraged configuration maintains compression of the strip on the starter sheet by the action of the expansion member that is forced into the lever slot opposing the edge slot along the length of the starter sheet. Obviously, the leveraging effect of the expansion member is affected by the rigidity of the strip's material, a greater rigidity of the hinge component limiting the leveraging action transferred to the edge slot and the corresponding adherence of the strip tips to the starter sheet surface. On the other hand, sufficient rigidity in the lever-arm material is necessary to transfer the compressive force to the tip of the edge slot. The rigidity of the material utilized for this unibody configuration tends to cause longitudinal cracks in the hinge component, especially when the edge strip is mounted in cold weather. Therefore, in order to minimize this problem, the strips are commonly heated prior to installation in cold temperatures, with produces substantial inefficiency and related expense.

Perlich partially solved this problem by providing a dual-durometer edge that combines the longitudinal rigidity of a standard edge protector with the greater resilience of a coextruded converging lip made of softer material. This type of strip improves contact between the strip tips and the surface of the starter sheet because of the compressive force exerted by the converging resilient material at the tip of the edge slot, thereby ensuring contact at the tip even without a leveraging action, but its performance remains sensitive to the resilience of the soft lips.

Therefore, there still exists a need for an improved electrode edge protector. The present invention provides a simple method of construction for producing such an improved device.

BRIEF SUMMARY OF THE INVENTION

The primary objective of this invention is an electrode edge protector that provides optimal fit characteristics for protecting an electrode's edge and preventing penetration of solution during an electrolytic process.

Another goal of the invention is an H-shaped edge strip that comprises opposing slots defined by two rigid lever arms interconnected by a hinge member, such that an expansive force exerted on one slot produces leveraged compression of the other slot over the edge of the electrode.

Another objective is an edge strip having rigid lever arms and a resilient hinge, thereby maximizing the leverage action between the opposing slots and optimizing the ability of the edge strip to conform to variations in electrode thickness and surface smoothness.

Another goal is to provide an electrode edge protector that performs reliably when used with various types of electrodes, and different types of automated mechanical stripping machines and electrode handling equipment.

Finally, an objective is a design and method of manufacture for such a cathode that accomplishes the above mentioned goals in an economical and commercially viable manner.

Therefore, according to these and other objectives, the present invention is an electrode edge protector that includes an elongate strip having a substantially H-shaped cross-section in combination with an expansion member. The strip comprises two lever-arm portions made of rigid material that define a longitudinal edge slot for receiving and wrapping around the edge of an electrode and an opposing expansion slot for receiving the expansion member. The rigid lever-arm portions are interconnected between the two slots by a coextruded hinge member made of resilient material which enhances the ability of the edge strip to adhere to the electrode in the edge slot as a result of the force exerted by the expansion member in the expansion slot.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS OF THE INVENTION

The heart of this invention lies in the idea of combining two or more coextruded materials having different physical properties in an endeavor to match the specific requirements of each functional component of conventional plastic edge strips, thereby enhancing the performance characteristics of the unit. By matching the rigidity and resilience of each separate component to its functional requirements, the overall result is a strip that ensures easier application and better adhesion to the starter sheet through surface irregularities and temperature fluctuations.

Figure 1:
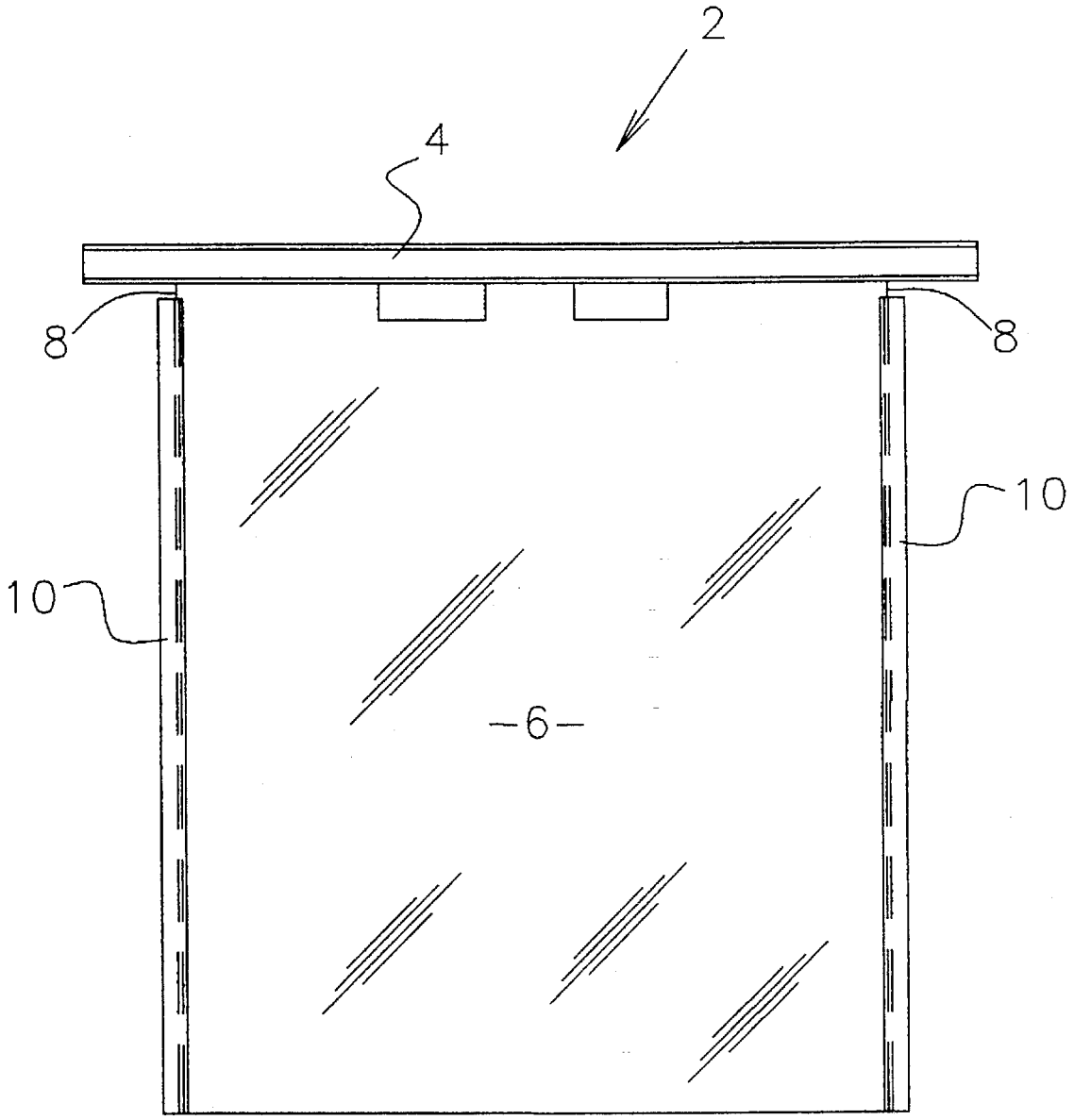
FIG. 1 (PRIOR ART)
FIG. 1 is an elevational view of a typical prior-art electrode for the electro-deposition of metal electrolytes.
Figure 2:
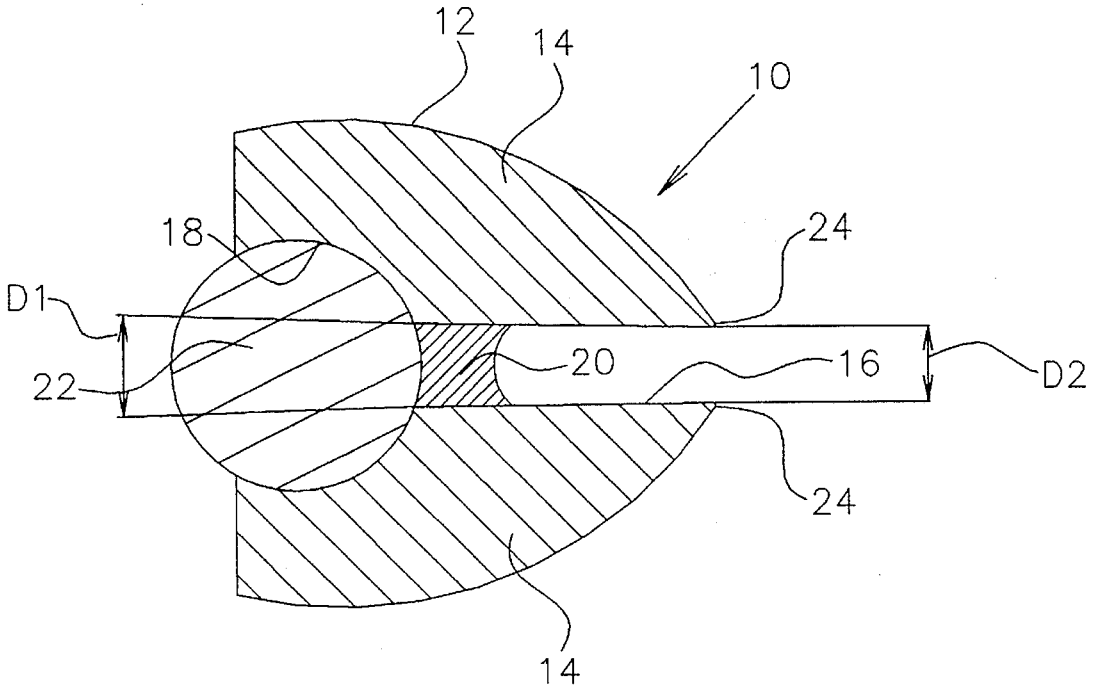
FIG. 2 is a cross-sectional view of an edge protector manufactured according to the present invention.

It is noted that edge strips are used in the industry in connection with electrodes conventionally called starter sheets, mother plates or mother blanks, depending on the process. The term starter sheet is used throughout this disclosure meaning any one of these types of electrode. Referring to the drawings, wherein like parts are designated throughout with like numerals and symbols, FIG. 1 illustrates in elevational view a typical electrolytic cathode 2 according to the prior art including a hanger bar 4 with a starter sheet 6 attached to it and edge strips 10 mounted along the double-sided edges 8 of the starter sheet to prevent deposition and accumulation of electrolyte. FIG. 2 shows the cross-section, which is uniform along the length of the device, of an embodiment of an edge protector assembly 10 according to the present invention. The assembly 10 comprises a continuous edge strip 12 (preferably of a length sufficient to cover a lateral edge 8 of the starter sheet 6, or the bottom edge thereof, as applicable) having two longitudinal grooves of the type disclosed by Berger in U.S. Pat. No. 4,406,769. The structural configuration of the strip 12 comprises two rigid lever-arm portions 14 that define a longitudinal, generally parallel-sided edge slot 16 and an opposite longitudinal, generally semicircular-sided expansion slot 18. The two lever-arm portions 14 are interconnected by a longitudinal resilient hinge member 20 bonded to each portion approximately at the midsection between the opposing slots 16 and 18. Finally, the assembly 10 also comprises a separate compression member 22 that consists of an elongate rod of circular section adapted for snap-fit engagement in the expansion slot 18.

The size of the edge slot 16 is selected for close-fitting, tight frictional engagement with opposite parallel surfaces of the electrode's double-sided edge 8 and is preferably narrower at the tips 24 of the slot than at the point of connection with the hinge member 20. Obviously, the exact dimensions depend on the thickness of the starter sheet for which the edge strip is intended; for an optimal fit, the inner distance D1 should approximate the thickness of the starter sheet while the outer thickness D2 should be sufficiently smaller to ensure contact of the tips 24 with the electrode surface. Typically, for a starter sheet 0.135 inches thick, D1 and D2 are 0.135 and 0.120 inches, respectively. The cross-sectional dimensions of the expansion slot 18 and member 22 are selected to ensure that the slot 18 is slightly enlarged when the member 22 is engaged, thereby providing a lever action around the hinge member 20 that causes the tips 24 to converge and press tightly over the surface of the starter sheet 6.

The strip assembly 10 is installed simply by slipping it over the edge of the starter sheet such that it fits snugly within the edge slot 16 while the expansion member 22 is dislodged from the expansion slot 18, and the expansion member 22 is then forced into the slot 10 by tapping or otherwise to cause its expansion and the corresponding compression of the edge slot 16 over the edge 8 of the electrode. An insulating tape may be used wrapped around the starter-sheet edge 8, as conventionally done with prior-art edge protectors. During the process of installation, the resilient hinge member 20 facilitates the initial fitting of the starter sheet's edge into the edge slot 16 and the subsequent coupling of the expansion member 22 with the edge strip 12 by permitting the momentary separation of each slot's sides as required for engagement of the electrode edge and of the expansion member. Moreover, and most importantly, the difference in flexibility and stretchability between the rigid lever-arm portions 14 and the resilient hinge member 20 cause the flexing and expansion (if necessary for the complete insertion of the starter-sheet edge) of the hinge member 20 to the extent necessary to transfer the compressive force exerted by the expansion member 22 to the tips 24 of the edge slot 16.

It is understood that all components of the edge protector assembly 10 are manufactured with electrically insulating materials that are chemically and thermally stable in the environments of intended use, such as polypropylene, polyvinylchloride (PVC), acrylic/polyvinyl chloride (APVC), chlorinated polyvinylchloride (CPVC) and acrylonitrile-butadiene-styrene (ABS) components. Within these classes of materials, a relatively rigid and hard plastic is selected for the lever-arm portions of the strip 12 and for the expansion member 22, while a relatively flexible and resilient plastic is selected for the hinge member 20, such plastics being preferably capable of coextrusion. The materials chosen for the preferred embodiment of the invention have a durometer hardness in the range of 75 to 90 on the D scale (such as CPVC's) for the rigid components and have a durometer rating in the range of 60 to 80 on the D scale (such as PVC's) for the resilient hinge member. It is understood that the materials will always be chosen such that the one used for the hinge member is materially softer than the one used for the rigid components.

The manufacture of the coextruded edge strip 12 is accomplished in an extrusion process as described in U.S. Pat. No. 4,776,928, herein incorporated by reference, wherein a coextrusion die having the shape of the cross-sectional view of FIG. 2 is utilized. The operating conditions and parameters for coextruding dual-durometer materials are well known in the art; therefore, they are not addresses here.

Figure 3:
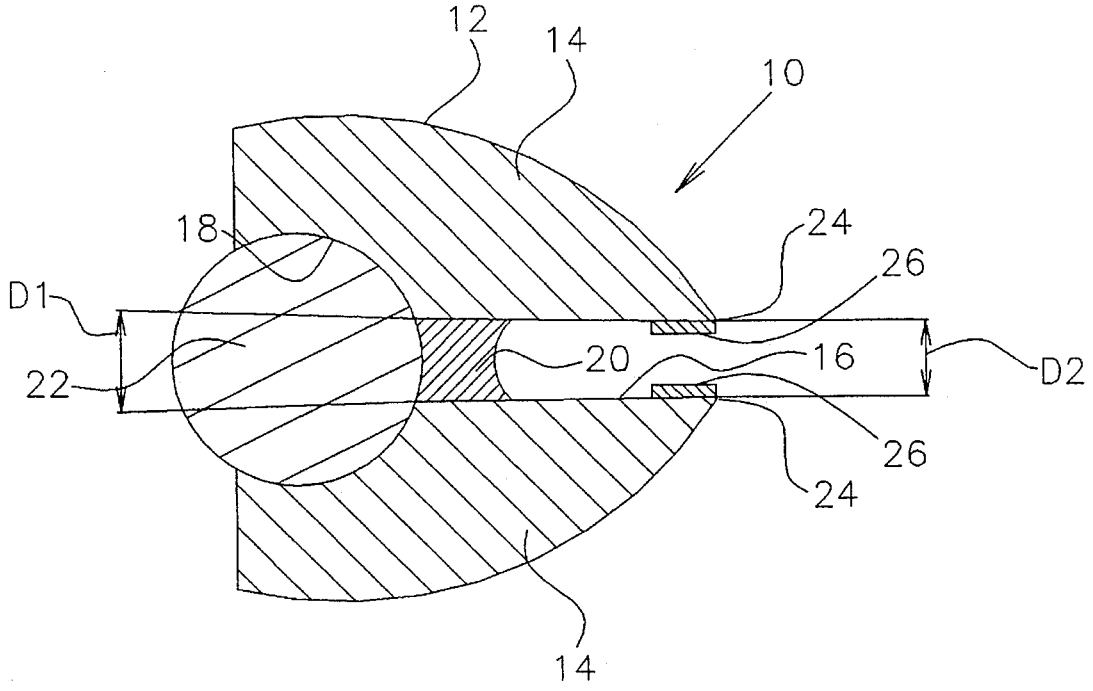
FIG. 3 is a cross-sectional view of another embodiment of an edge protector according to the invention including a longitudinal lining of resilient material inside the walls of the edge slot.
Figure 4:
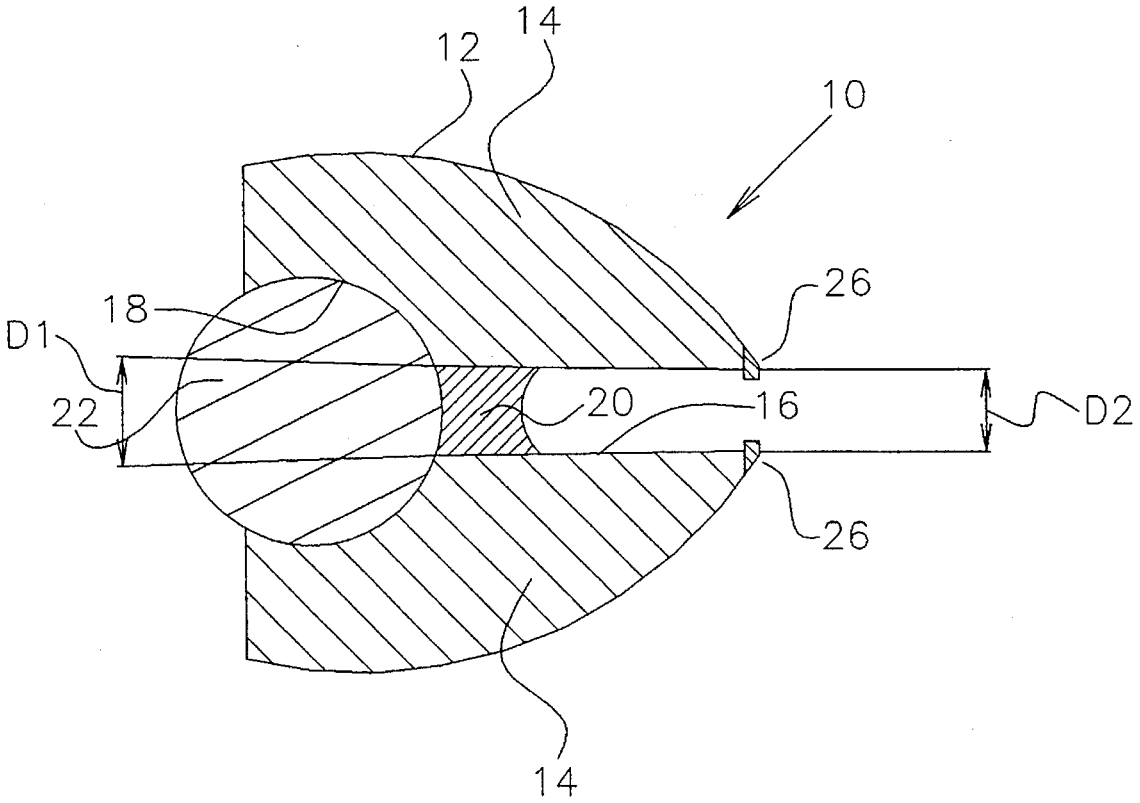
FIG. 4 is a cross-sectional view of yet another embodiment including a lining of resilient material at the tips of the edge slot.
Figure 5:
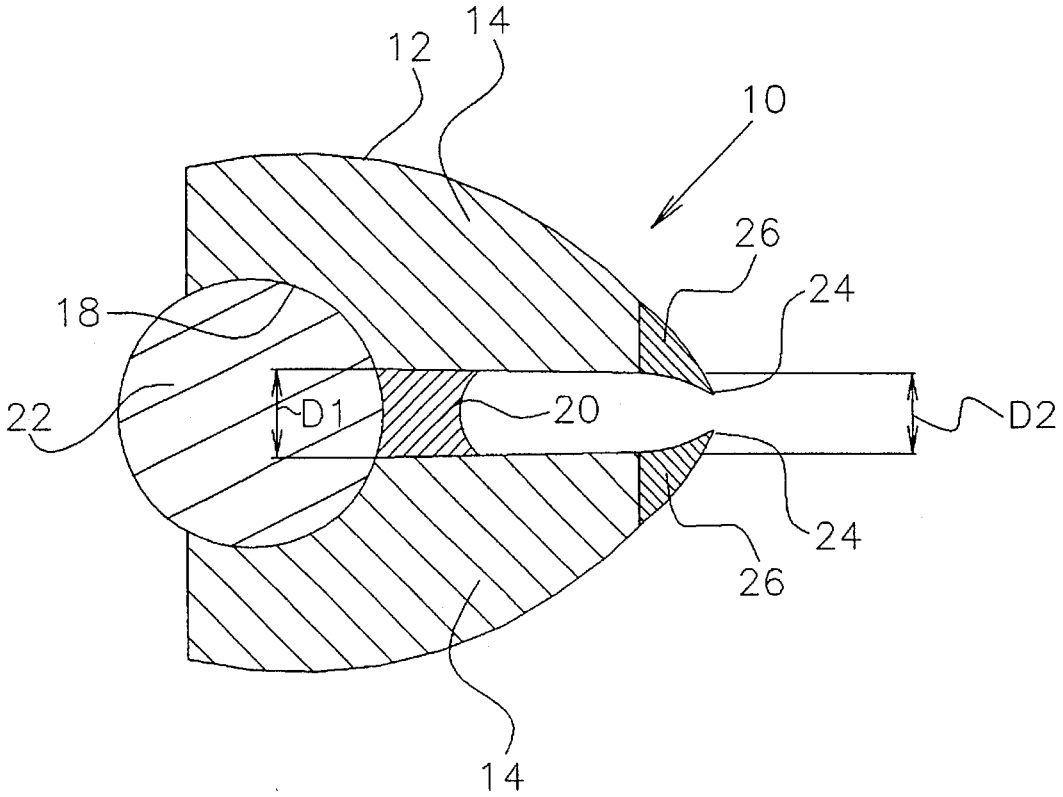
FIG. 5 is a cross-sectional view of an embodiment wherein the tips of the edge slot are coextruded with resilient material.

In another embodiment of the invention, the edge strip 12 is further improved by the addition of a layer of relatively-soft and resilient material 26 to the tips 24 of the edge slot 16. This material further improves contact between the electrode surface and the tips of the edge slot, thereby further enhancing prevention of electrolyte penetration. The layer 26 of resilient material may be attached longitudinally as a lining to the walls of the edge slot, as illustrated in FIG. 3, or it may be attached to the tips 24 as an inward-protruding member, as seen in FIG. 4. Alternatively, as shown in FIG. 5, the layer 26 may constitute the tip itself. In all cases, the layer 26 may consist of the same resilient material utilized for the hinge member 20 and is preferably capable of coextrusion with the rigid material utilized for the lever-arm portions 14 of the invention.

Figure 6:
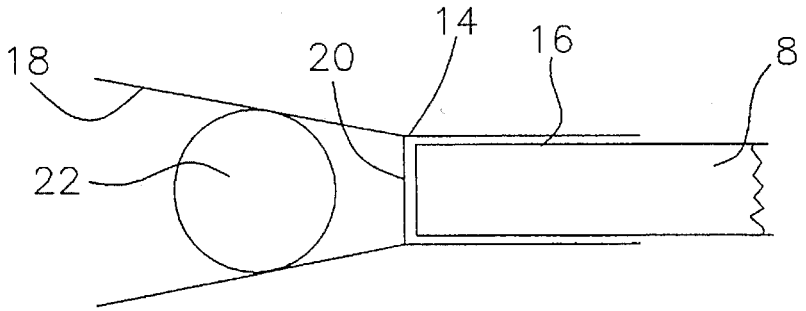
FIG. 6 is a schematic view, exaggerated for illustration, of the likely performance of a prior-art edge protector of unibody construction manufactured with a rigid material.
Figure 7:
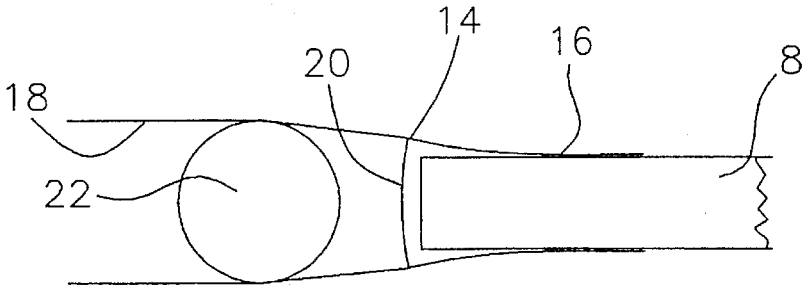
FIG. 7 is a schematic view, exaggerated for illustration, of the likely performance of a prior-art edge protector of unibody construction manufactured with a resilient material.

In structural terms, the present invention differs from the Berger's device in the dual-material approach to its construction which makes it possible to select materials of specific rigidity and resilience that best suit the function of each component. Thus, in functional terms, the resilient hinge member 20 causes the expansion force exerted by the member 22 on the rigid lever-arm portions 14 to be transmitted to the tips 24 substantially in its entirety, so that the pressure exerted against the surface of the electrode edge 8 is maximized. In contrast, the uniform-material construction of the Berger device requires a compromise between the resilience desirable for the hinge material and the rigidity desirable for the lever-arm material. If the plastic selected is uniformly too rigid, the hinge portion of the edge strip will not allow its deformation to the extent necessary to transmit the force exerted by the expansion member to the tips of the edge slot; if the material is uniformly too resilient, the lever-arm portions of the strip will flex as well as the hinge and the force will be transmitted preferentially to the inner portion of the edge slot, rather than to the tips where maximum adherence is needed to prevent electrolyte penetration. These two cases are illustrated schematically in FIGS. 6 and 7, respectively.

Obviously, the specific geometry of the expansion slot 18 and member 22 are not critical to the invention so long as adapted to cooperatively exert a compressive force on the starter sheet when the expansion member is inserted in the slot. The circular cross-sectional geometry of the expansion member 22 and the correspondingly conforming slightly-greater-than-semicircular geometry of the slot 18 used in the prior art are preferred because convenient and suitable for snap-fit engagement. It is noted that the diameter of the expansion member 22 must be such that it causes the expansion of the expansion slot 18 and the corresponding compression of the edge slot 16 upon engagement of the two. Due to the resilience of the hinge member 20 and the rigidity of the lever-arm portions 14, for the purposes of the present invention an expansion member 22 slightly larger than the slot 18 is acceptable because it will cause the hinge member 20 to stretch and the tips 24 to converge and press firmly against the starter sheet surfaces, thereby forming an improved continuous seal for the prevention of hydrolyte penetration.

In addition to the aforementioned advantages, the edge protector of the invention contains a more flexible hinge member that is much less likely to crack during installation than comparable strips made of a single, more rigid material. Moreover, because of the extrusion method of manufacture required for the strip of the invention, it results that the surface of the protector is free from machine marks and rough edges that are typical of machined products, thereby also avoiding the structural stresses and weak points that might cause failures in those products.

Various other changes in the details, steps and materials that have been described may be made by those skilled in the art within the principles and scope of the invention herein illustrated and defined in the appended claims. Thus, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and methods.

I claim:

1. An edge protector assembly for an electrode having a double-sided edge, comprising the following elements:

an edge strip consisting of an elongate structure having a uniform cross-section comprising two lever-arm portions of a first plastic material interconnected by a hinge member of a second plastic material, said cross-section defining an edge slot and an expansion slot on opposite sides thereof; and an elongate expansion member adapted for engagement in said expansion slot;

wherein said lever-arm portions consist of separate structures held together by said hinge member; and wherein said edge slot is adapted for close-fitting engagement of said double-sided edge of an electrode, and said first plastic material is rigid and said second plastic material is resilient.

2. The edge protector of claim 1, wherein said first material is selected from the group consisting of polypropylene, chlorinated polyvinylchloride and acrylonitrile-butadiene-styrene.

3. The edge protector of claim 1, wherein said second material is selected from the group consisting of polyvinylchloride and acryl/polyvinylchloride.

4. The edge protector of claim 2, wherein said second material is selected from the group consisting of polyvinylchloride and acryl/polyvinylchloride.

5. The edge protector of claim 1, wherein said first material has a durometer rating in the range of 75 to 90 on the D scale.

6. The edge protector of claim 1, wherein said second material has a durometer rating in the range of 60 to 80 on the D scale.

7. The edge protector of claim 5, wherein said second material has a durometer rating in the range of 60 to 80 on the D scale.

8. The edge protector of claim 1, wherein said first and second materials are coextruded.

9. The edge protector of claim 1, wherein said expansion member has a circular cross-section and said expansion slot has a conforming slightly-greater-than-semicircular cross-section for snap-fit engagement therewith.

10. The edge protector of claim 1, wherein said edge slot includes inward converging tips.

11. The edge protector of claim 1, further comprising a layer of resilient material attached longitudinally to a wall of the edge slot.

12. The edge protector of claim 11, wherein said layer of resilient material and said first and second materials are coextruded.

13. The edge protector of claim 1, further comprising a layer of resilient material attached longitudinally to a tip of the edge slot as an inward-protruding member.

14. The edge protector of claim 13, wherein said layer of resilient material and said first and second materials are coextruded.

15. The edge protector of claim 1, wherein said lever-arm portions include a member of resilient material defining a tip of said edge slot.

16. The edge protector of claim 15, wherein said member of resilient material and said first and second materials are coextruded.

17. The edge protector of claim 1, wherein said first material is selected from the group consisting of polypropylene, chlorinated polyvinylchloride and acrylonitrile-butadiene-styrene and has a durometer rating in the range of 75 to 90 on the D scale, said second material is selected from the group consisting of polyvinylchloride and acryl/polyvinylchloride and has a durometer rating in the range of 60 to 80 on the D scale, said first and second materials are coextruded, said expansion member has a circular cross-section and said expansion slot has a conforming slightly-greater-than-semicircular cross-section for snap-fit engagement therewith; and said edge slot includes inward converging tips.

18. The edge protector of claim 17, further comprising a layer of resilient material attached by coextrusion longitudinally to a wall of the edge slot.

19. The edge protector of claim 17, further comprising a layer of resilient material attached by coextrusion longitudinally to a tip of the edge slot as an inward-protruding member.

20. The edge protector of claim 17, wherein said lever-arm portions include a coextruded member of resilient material defining a tip of said edge slot.

* * * * *